US011460028B2

(12) United States Patent
Zheng et al.

(10) Patent No.: US 11,460,028 B2
(45) Date of Patent: Oct. 4, 2022

(54) PUMP BODY ASSEMBLY, COMPRESSOR AND AIR CONDITIONER

(71) Applicant: ANHUI MEIZHI PRECISION MANUFACTURING CO., LTD., Anhui (CN)

(72) Inventors: Licheng Zheng, Anhui (CN); Jin Li, Anhui (CN)

(73) Assignee: ANHUI MEIZHI PRECISION MANUFACTURING CO., LTD., Wuhu (CN)

( * ) Notice: Subject to any disclaimer, the term of this patent is extended or adjusted under 35 U.S.C. 154(b) by 0 days.

(21) Appl. No.: 17/535,801

(22) Filed: Nov. 26, 2021

(65) Prior Publication Data

US 2022/0082094 A1 Mar. 17, 2022

Related U.S. Application Data

(63) Continuation of application No. PCT/CN2019/109666, filed on Sep. 30, 2019.

(30) Foreign Application Priority Data

Jun. 28, 2019 (CN) ..... 201910576933.8

(51) Int. Cl.
*F04C 29/02* (2006.01)
*F04B 39/00* (2006.01)
(Continued)

(52) U.S. Cl.
CPC ..... *F04C 29/023* (2013.01); *F04B 39/0094* (2013.01); *F04C 2/02* (2013.01);
(Continued)

(58) Field of Classification Search
CPC ..... F04C 2/02; F04C 15/0088; F04C 18/02; F04C 18/04; F04C 18/324; F04C 18/322;
(Continued)

(56) References Cited

U.S. PATENT DOCUMENTS 2,643,817 A * 6/1953 Makaroff ..... F04C 18/322 418/66
6,409,488 B1 * 6/2002 Ikoma ..... F04C 18/3564 418/67
(Continued)

FOREIGN PATENT DOCUMENTS

CN 202597108 U 12/2012
CN 203130513 U 8/2013
(Continued)

OTHER PUBLICATIONS

International Search Report dated Mar. 26, 2020 issued in PCT/CN2019/109666, 5 pages.
(Continued)

*Primary Examiner* — Christopher S Bobish
(74) *Attorney, Agent, or Firm* — Scully Scott Murphy & Presser

(57) ABSTRACT

A pump body assembly, a compressor and an air conditioner are provided. The pump body assembly has a crankshaft, a main bearing, and a cylinder body. The crankshaft has a main shaft part and an eccentric part connected with the main shaft part. The main bearing has a hub part. The main shaft part extends through a through hole in the hub part. A first oil guide groove is formed in the hole wall of the through hole. A sliding vane slot and a center hole are formed in the cylinder body. The crankshaft extends through the center hole. The main bearing is located at the one side of the cylinder body. The crankshaft and the main bearing are in uniform contact with oil films at all positions. The abnormal wear of the main shaft part of the crankshaft can be reduced, and the service life of the compressor can be prolonged.

16 Claims, 6 Drawing Sheets

(51) Int. Cl.

| | |
|---|---|
| ***F04C 18/04*** | (2006.01) |
| ***F04C 18/356*** | (2006.01) |
| ***F04C 18/32*** | (2006.01) |
| ***F04C 15/00*** | (2006.01) |
| ***F04C 18/324*** | (2006.01) |
| ***F04C 2/02*** | (2006.01) |
| ***F04C 18/02*** | (2006.01) |

(52) U.S. Cl.
CPC ..... *F04C 15/0088* (2013.01); *F04C 18/02* (2013.01); *F04C 18/04* (2013.01); *F04C 18/32* (2013.01); *F04C 18/322* (2013.01); *F04C 18/324* (2013.01); *F04C 18/3562* (2013.01); *F04C 18/3564* (2013.01); *F04C 2230/603* (2013.01)

(58) Field of Classification Search
CPC .. F04C 18/3562; F04C 18/3564; F04C 18/32; F04C 29/023; F04C 2230/603
See application file for complete search history.

(56) References Cited

U.S. PATENT DOCUMENTS

| | | | | |
|---|---|---|---|---|
| 8,182,253 | B2 * | 5/2012 | Hirayama | F04C 23/008 418/60 |
| 9,097,254 | B2 * | 8/2015 | Lee | F04C 29/0085 |
| 10,260,504 | B2 * | 4/2019 | Zhou | F04C 29/023 |
| 2011/0067434 | A1 * | 3/2011 | Miura | F04C 23/001 418/157 |

FOREIGN PATENT DOCUMENTS

| | | | |
|---|---|---|---|
| CN | 103696966 | A | 4/2014 |
| CN | 203742998 | U | 7/2014 |
| CN | 105090042 | A | 11/2015 |
| CN | 105221430 | A | 1/2016 |
| CN | 105715550 | A | 6/2016 |
| CN | 205858673 | U | 1/2017 |
| CN | 106640661 | A | 5/2017 |
| CN | 106795875 | A | 5/2017 |
| CN | 108661908 | A | 10/2018 |
| JP | 03-134292 | A | 6/1991 |
| JP | 2000130371 | A | 5/2000 |
| JP | 2013-108375 | A | 6/2013 |
| JP | 2017-053221 | A | 3/2017 |
| JP | 2020-037887 | A | 3/2020 |
| WO | 2018/179356 | A1 | 10/2018 |

OTHER PUBLICATIONS

Notice of Reasons for Refusal dated May 31, 2022 received in Japanese Patent Application No. JP 2021-569979 together with an English language translation.
First Office Action dated Apr. 26, 2021 received in Chinese Patent Application No. CN 201910576933.8 together with an English language translation.

* cited by examiner

PUMP BODY ASSEMBLY, COMPRESSOR AND AIR CONDITIONER

CROSS-REFERENCE TO RELATED APPLICATIONS

The present application is a continuation application of PCT International Application No. PCT/CN2019/109666, filed on Sep. 30, 2019, which claims priority to and benefits of Chinese Patent Application No. 201910576933.8 filed with China National Intellectual Property Administration on Jun. 28, 2019 and entitled "PUMP BODY ASSEMBLY, COMPRESSOR AND AIR CONDITIONER", the entire contents of which are incorporated herein by reference for all purposes. No new matter has been introduced.

FIELD

The present disclosure relates to the technical field of compressors, and in particular to a pump body assembly, a compressor and an air conditioner.

BACKGROUND

At present, crankshaft lubrication for a pump body of a compressor in a related art is generally achieved by supplying oil through a spiral oil applying blade mounted in an inner hole in the lower part of an auxiliary shaft of a crankshaft. Lubrication for a main shaft part and the auxiliary shaft part of the crankshaft is mainly achieved by supplying oil through oil guide grooves formed in inner holes of a main bearing and an auxiliary bearing. The dimension and the position design of the oil guide grooves is an important factor that affects crankshaft lubrication. If the design is improper, insufficient oil supply to the main shaft part of the crankshaft will be caused when the compressor is running, thereby resulting in worsened wear of the crankshaft and main bearing. In several cases, the service life of the compressor even may be affected as a result of problems such as pump body blockage, crankshaft fracture and the like.

SUMMARY

The present disclosure aims to solve at least one of the technical problems existing in the prior art or related art.

In view of this, according to a first aspect of the present disclosure, a pump body assembly is provided.

According to a second aspect of the present disclosure, a compressor is provided.

According to a third aspect of the present disclosure, an air conditioner is provided.

In view of this, according to one aspect of the present disclosure, a pump body assembly is provided, comprising: a crankshaft including a main shaft part and an eccentric part connected with the main shaft part, wherein a distance between a center line of the main shaft part and a center line of the eccentric part is e; a main bearing including a hub part, wherein the main shaft part penetrates through a through hole in the hub part, and a first oil guide groove is formed in the wall defining the through hole; and a cylinder body, wherein a sliding vane slot and a center hole are formed in the cylinder body, the crankshaft penetrates through the center hole, the main bearing is located at one side of the cylinder body, a radius of the center hole is R, and a difference value between R and e is r. A value range of an included angle formed of a first connection line between a center of the center hole and that of the sliding vane slot in a same projection plane and a second connection line between a termination point of the first oil guide groove at one end of the hub part away from the eccentric part and a center of the through hole is smaller than or equal to the sum of 17π/18 and $$\frac{1}{2}\arcsin\left(\frac{e}{2r}\right),$$

and greater than or equal to the sum of 5π/9 and $$\frac{1}{2}\arcsin\left(\frac{e}{2r}\right).$$

The included angle of the pump body assembly is a rotation angle corresponding to the rotation of the crankshaft from the first connection line to the second connection line.

The pump body assembly provided by the present disclosure includes a crankshaft, a main bearing and a cylinder body, wherein the crankshaft includes a main shaft part and an eccentric part connected with the main shaft part, and an eccentric distance e between a center line of the main shaft part and a center line of the eccentric part is provided; the main bearing includes a hub part with a through hole therein, wherein a first oil guide groove is formed in the wall defining the through hole, the main shaft part penetrates through the through hole, and a center hole and a sliding vane slot in communication with the center hole are formed in the cylinder body, the crankshaft penetrates through the center hole of the cylinder body, the main bearing is arranged at one side of the cylinder body, a radius of the center hole is R, and a difference value between R and e is r. In the same projection plane in the axial direction of the center hole, the center of the center hole is connected with the center of the sliding vane slot to form a first connection line, and a termination point of the first oil guide groove at one end away from the eccentric part is connected with the center of the through hole in the hub part to form a second connection line; in the same projection plane in the axial direction of the center hole, the first connection line between the center of the center hole in the cylinder body and the center of the sliding vane slot is defined as a 0-degree direction, and an angle increase direction is the same with a rotation direction of crankshaft; and a rotation angle corresponding to the rotation of the crankshaft from the first connection line to the second connection line is an included angle, which is greater than or equal to $$5\pi/9 + \frac{1}{2}\arcsin\left(\frac{e}{2r}\right)$$

and smaller than or equal to $$17\pi/18 + \frac{1}{2}\arcsin\left(\frac{e}{2r}\right).$$

By defining a relationship among the included angle formed of the first connection line between the center of the center hole in the same projection plane in the axial direction of the center hole and the center of the sliding vane slot and the second connection line between the termination point of the first oil guide groove at one end of the hub part away from the eccentric part and the center of the through hole, crankshaft eccentricity e and the radius R of the center hole of the cylinder body, oil supply of the oil grooves is more sufficient and an oil film on each portion of the main shaft part of the crankshaft is more uniform when the crankshaft deforms under action of external load to be in contact with the main bearing, thereby effectively improving the problem of the abnormal wear of the main shaft part of the crankshaft, avoiding the problems such as pump body blockage, crankshaft fracture and the like, and prolonging the service life of the compressor.

In addition, the pump body assembly in the embodiment provided by the present disclosure further has the following additional technical features.

In the embodiment, the pump body assembly is provided with one cylinder body, and the value range of the included angle is smaller than or equal to the sum of 8π/9 and $$\frac{1}{2}\arcsin\left(\frac{e}{2r}\right),$$

and greater than or equal to the sum of 2π/3 and $$\frac{1}{2}\arcsin\left(\frac{e}{2r}\right).$$

In the embodiment, when the pump body assembly is a single-cylinder pump body assembly, the value range of the included angle meets the following formula: the included angle being greater than or equal to $$2\pi/3+\frac{1}{2}\arcsin\left(\frac{e}{2r}\right)$$

and smaller than or equal to $$8\pi/9+\frac{1}{2}\arcsin\left(\frac{e}{2r}\right)$$

In such a manner, oil supply of the oil grooves is more sufficient when the crankshaft deforms under action of external load to be in contact with the main bearing.

In any of the embodiments, the pump body assembly is provided with at least two cylinder bodies, and the value range of the included angle is smaller than or equal to the sum of 7π/9 and $$\frac{1}{2}\arcsin\left(\frac{e}{2r}\right),$$

and greater than or equal to the sum of 11π/18 and $$\frac{1}{2}\arcsin\left(\frac{e}{2r}\right).$$

In the embodiment, when the pump body assembly is a multi-cylinder pump body assembly, the value range of the included angle meets the following formula: the included angle being greater than or equal to $$11\pi/18+\frac{1}{2}\arcsin\left(\frac{e}{2r}\right)$$

and smaller than or equal to $$7\pi/9+\frac{1}{2}\arcsin\left(\frac{e}{2r}\right).$$

In such a manner, oil supply of the oil grooves is more sufficient when the crankshaft deforms under action of external load to be in contact with the main bearing. Furthermore, in a process that a multi-cylinder compressor rotates around the crankshaft, gas force has a plurality of peak values, and there is greater difference between a direction (corresponding to a direction of centrifugal force) of a balance block and a single-cylinder compressor, so that the optimal range of the termination angle of the oil groove of the multi-cylinder compressor is not completely consistent with that of the single-cylinder compressor; and the positions of the oil grooves are different according to different numbers of the cylinder bodies, so that the best lubrication effect is achieved.

In any of the embodiments, the value range of the included angle formed of the first connection line in the same projection plane of the pump body assembly and a third connection line between a termination point at another end of the first oil guide groove and the center of the through hole is smaller than or equal to 2π and greater than or equal to 3π/2.

In the embodiment, the third connection line is formed by the termination point at another end of the first oil guide groove and the center of the through hole, and the included angle formed of the first connection line and the third connection line greatly affects the reliability of the crankshaft. By setting the value range of the included angle formed of the first connection line and the third connection line to be smaller than or equal to 2π and greater than or equal to 3π/2, oil supply of the oil grooves is more sufficient and the reliability of the main shaft part of the crankshaft is better when the crankshaft deforms under action of external load to be in contact with the main bearing.

In any of the embodiments, the pump body assembly further includes a first annular groove which is formed in the wall defining the through hole, and the first oil guide groove is communicated with the first annular groove.

In the embodiment, the pump body assembly further includes a first annular groove formed in the wall defining the through hole, and the first annular groove is communicated with the first oil guide groove; an annular groove is formed in the inner surface of the hub part of the main bearing, so that oil supply amount between the hub part of the main bearing and the main shaft part of the crankshaft may be further increased. In such a manner, a lubricating condition of the main shaft part of the crankshaft is improved. And meanwhile, contact area between the hub part of the main bearing and the main shaft part of the crankshaft is reduced through the first annular groove, so that viscous resistance and friction loss between the two are reduced, and the performance of the compressor is improved.

In any of the embodiments, the pump body assembly further includes an oil passing hole which is formed in the first annular groove, and the oil passing hole penetrates through the hub part in a radial direction.

In the embodiment, the oil passing hole is formed in the first annular groove, and penetrates through the hub part in the radial direction, so that circulating performance between lubricating oil on the inner surface of a hub and lubricating oil outside may be improved, and a temperature of the lubricating oil in the hub is reduced to certain extent. In such a manner, the lubricating reliability of the main shaft part of the crankshaft is further improved.

In any of the embodiments, a radial depth of the first annular groove of the pump body assembly is smaller than or equal to 0.5 mm.

In the embodiment, the radial depth of the first annular groove is limited to be not greater than 0.5 mm, such that the first annular groove slightly affects the rigidity of the entire pump body assembly.

In the embodiment, the pump body assembly further includes a second annular groove which is formed in the main shaft part and is located in an area where the main shaft part is matched with the hub part.

In the embodiment, a second annular groove is formed in the area where the main shaft part is matched with the hub part, such that oil supply amount between the hub part of the main bearing and the main shaft part of the crankshaft may be further increased. In such a manner, a lubricating condition of the main shaft part of the crankshaft is improved. Meanwhile, contact area between the hub part of the main bearing and the main shaft part of the crankshaft is reduced through the second annular groove, so that viscous resistance and friction loss between the two are reduced, and the performance of the compressor is improved.

In any of the embodiments, a radial depth of the second annular groove of the pump body assembly is smaller than or equal to 0.5 mm.

In the embodiment, the radial depth of the second annular groove is limited to be not greater than 0.5 mm, such that the integral rigidity of the crankshaft is guaranteed. In such a manner, the second annular groove is ensured to slightly affect the rigidity of the entire pump body assembly.

In any of the embodiments, the crankshaft of the pump body assembly further includes an auxiliary shaft part, and the eccentric part is located between the main shaft part and the auxiliary shaft part; the pump body assembly further includes an auxiliary bearing; the main bearing is sleeved on the main shaft part; the auxiliary bearing is sleeved on the auxiliary shaft part; the pump body assembly further comprises a second oil guide groove which is formed in a through hole of the auxiliary bearing.

In the embodiment, the crankshaft further includes an auxiliary shaft part which is connected with the eccentric part; bearings include a main bearing and an auxiliary bearing, which are respectively located at the two sides of the cylinder body; the main bearing is matched with the main shaft part, the auxiliary bearing is matched with the auxiliary shaft part, a first oil guide groove is formed in the main bearing and a second oil guide groove is formed in the through hole of the auxiliary bearing. The first oil guide groove is formed in the through hole of the main bearing, and the second oil guide groove is formed in the through hole of the auxiliary bearing, such that lubricating oil enters a position between the main bearing and the main shaft part and a position between the auxiliary bearing and the auxiliary shaft part. In such a manner, a lubricating condition between the main shaft part and the auxiliary shaft part of the crankshaft is improved.

In any of the embodiments, the pump body assembly further includes: the value range of the included angle formed of the first connection line between the center of the center hole in the same projection plane and the center of the sliding vane slot and a fourth connection line between a termination point of the second oil guide groove at one end of the hub part close to the eccentric part and the center of the through hole is smaller than or equal to $2\pi$ and greater than or equal to $3\pi/2$.

In the embodiment, in the same projection plane in the axial direction of the center hole, the termination point of the second oil guide groove at one end of the hub part close to the eccentric part and the center of the through hole define the fourth connection line; when the value range of the included angle formed of the first connection line and the fourth connection line is smaller than or equal to $2\pi$ and greater than or equal to $3\pi/2$, oil supply of the oil groove is more sufficient and the integral reliability of the crankshaft is better when the crankshaft deforms under action of external load to be in contact with the auxiliary bearing.

In any of the embodiments, the first oil guide groove and the second oil guide groove of the pump body assembly are both spiral oil guide grooves.

In the embodiment, the first oil guide groove and the second oil guide groove are both spiral oil guide grooves; in a running process of the compressor, flowing of lubricating oil is facilitated, such that the inner wall surface of the main bearing and the inner wall surface of the auxiliary bearing supply lubricating oil to the main shaft part and the auxiliary shaft part of the crankshaft under action of the spiral oil guide grooves. In such a manner, the main shaft part and the auxiliary shaft part of the crankshaft are both lubricated.

In the embodiment, spiral directions of the first oil guide groove and the second oil guide groove of the pump body assembly are the same with a rotation direction of the crankshaft.

In the embodiment, the spiral direction of the first oil guide groove and the spiral direction of the second oil guide groove are the same with the rotation direction of the crankshaft, such that lubricating oil may enter the first oil guide groove and the second oil guide groove under action of centrifugal force, and oil supply amount between the hub of the main bearing and the shaft part of the crankshaft is increased; the spiral direction of the first oil guide groove is the same with that of the second oil guide groove, such that the lubricating oil enters each position wherein the crankshaft is in contact with the hub part.

In any of the embodiments, a value range of a width of the first oil guide groove of the pump body assembly is smaller than or equal to 5 mm and greater than or equal to 1.5 mm; and a value range of a depth of the first oil guide groove is smaller than or equal to 3 mm and greater than or equal to 0.3 mm.

In the embodiment, when the value range of the width of the first oil guide groove is greater than or equal to 1.5 mm and smaller than or equal to 5 mm and the value range of the depth of the first oil guide groove is greater than or equal to 0.3 mm and smaller than or equal to 3 mm, the lubricating reliability of the crankshaft is better.

According to a second aspect of the present disclosure, a compressor is provided, including the pump body assembly according to any of the embodiments. As a result, the compressor has all the beneficial effects of the pump body assembly, which will not be detailed here.

According to a third aspect of the present disclosure, an air conditioner is provided, including the pump body assembly or the compressor according to any of the embodiments. As a result, the air conditioner has all the beneficial effects of the pump body assembly or the compressor, which will not be detailed here.

Additional aspects and advantages of the present disclosure will be obvious from the description below, or be learned by practice of the present disclosure.

BRIEF DESCRIPTION OF THE DRAWINGS

The above and/or additional aspects and advantages of the present disclosure will become obvious and easy to understand from the description of the embodiments in conjunction with the following drawings, in which.

Figure 1:
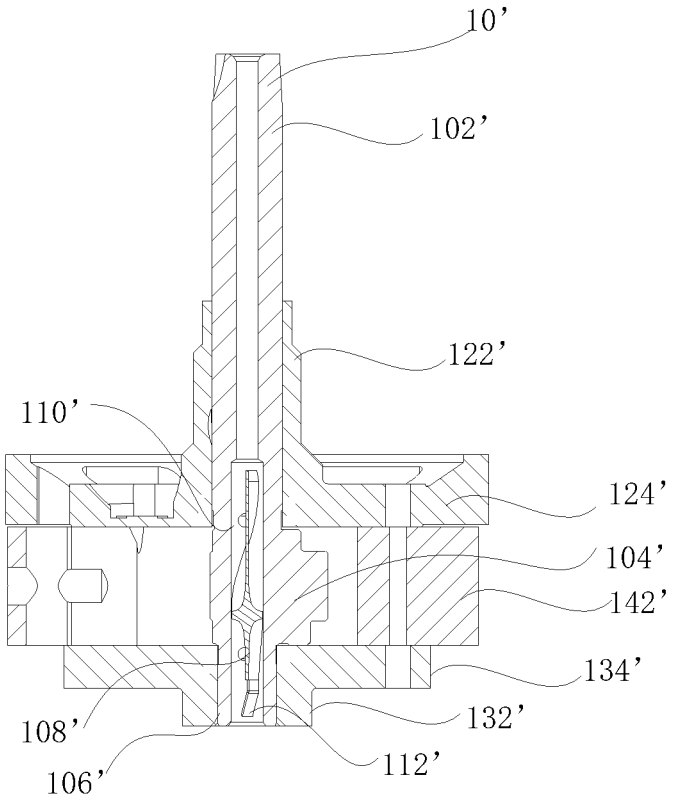
Fig. 1 (Prior Art)
FIG. 1 shows a structural schematic diagram of a pump body assembly in the prior art.

The reference numerals and components designated by these reference numerals, as shown in FIG. 1, are described as follows:

10' crankshaft; 102' main shaft part; 104' eccentric part; 106' auxiliary shaft part; 108' auxiliary shaft oil hole; 110' oil hole; 112' oil applying blade; 122' main bearing hub; 124' main bearing flange; 132' auxiliary bearing hub; 134' auxiliary bearing flange; and 142' cylinder body.

Figure 2:
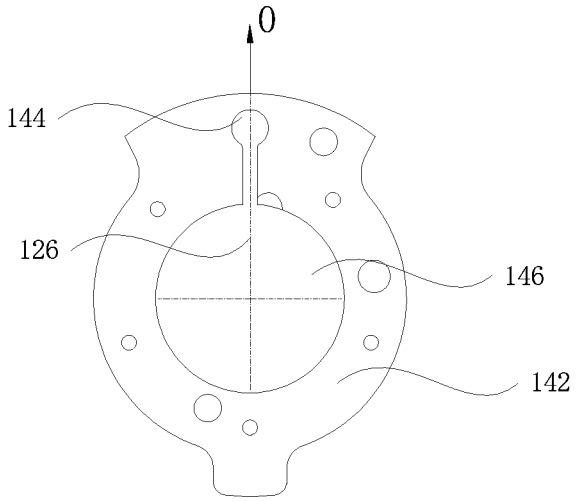

FIG. 2 shows a structural schematic diagram of a cylinder body in one embodiment of the present disclosure.

Figure 3:
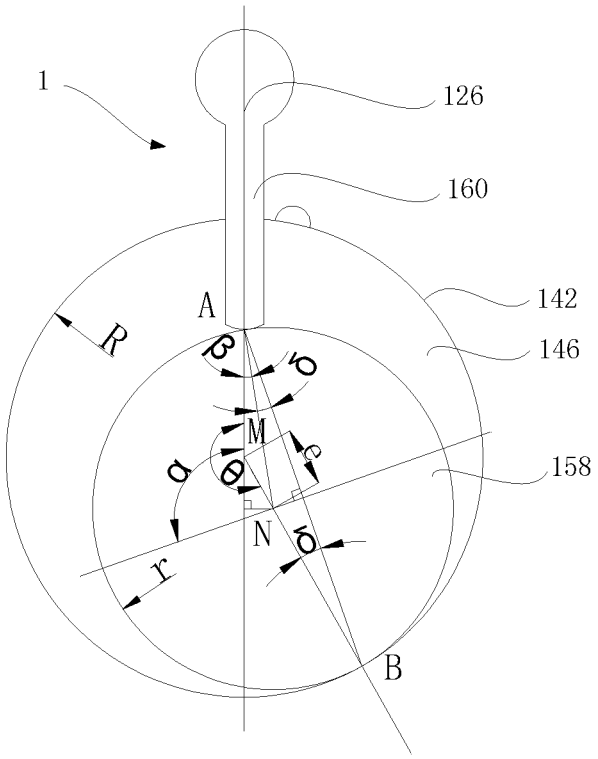

FIG. 3 shows a dimension and angle schematic diagram when a pump body assembly in one embodiment of the present disclosure is running.

Figure 4:
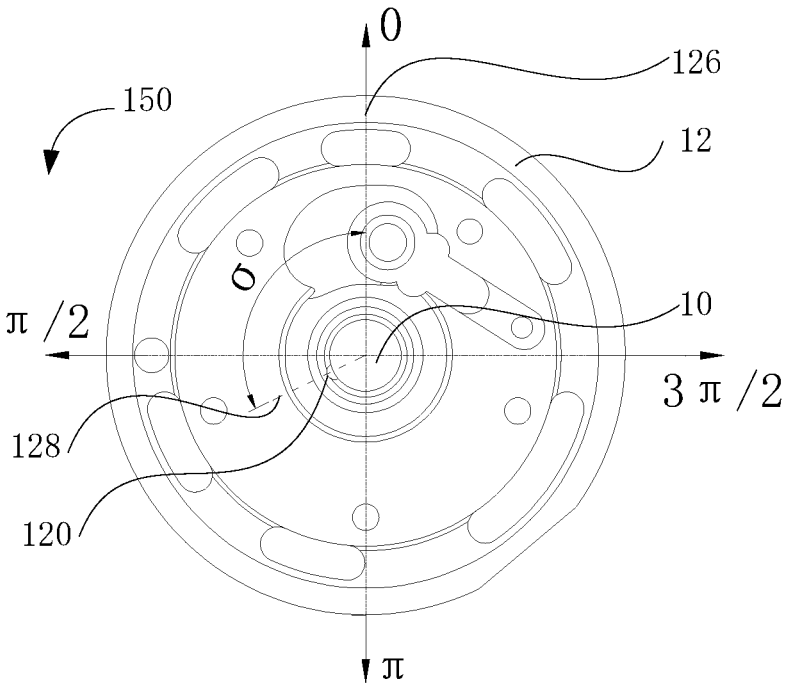

FIG. 4 shows a schematic diagram of a termination angle of a first oil guide groove away from a gas cylinder according to a main bearing of a pump body assembly in one embodiment of the present disclosure.

Figure 5:
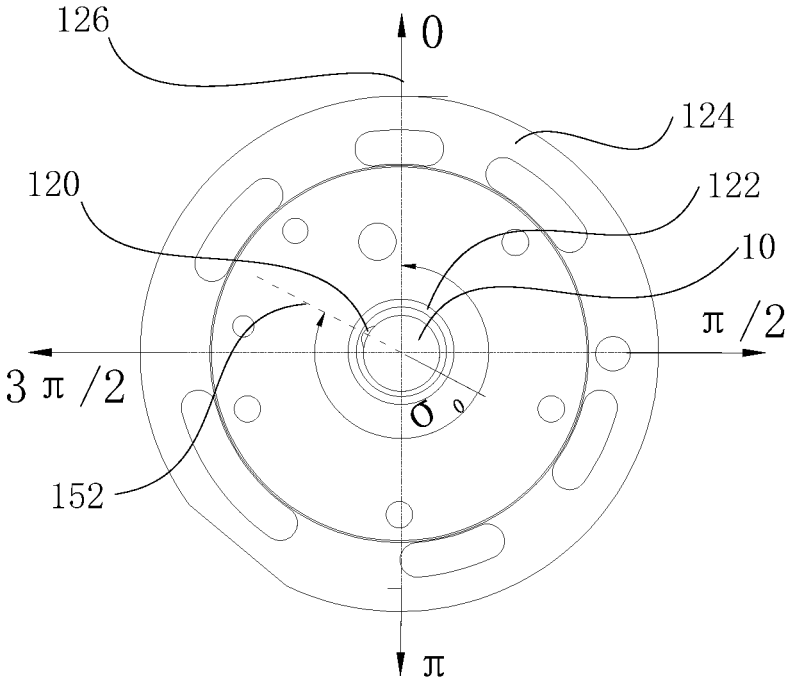

FIG. 5 shows a schematic diagram of a termination angle of a first oil guide groove close to a gas cylinder according to a main bearing of a pump body assembly in another embodiment of the present disclosure.

Figure 6:
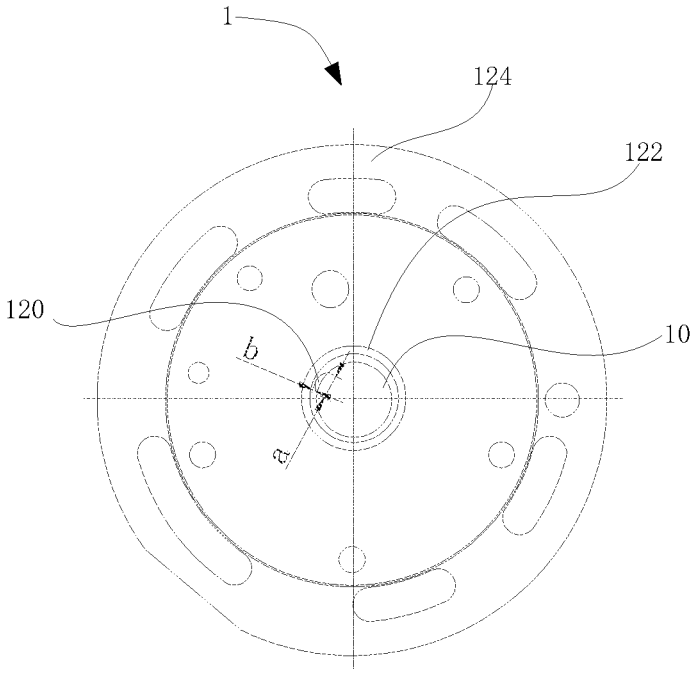

FIG. 6 shows a dimension and structure schematic diagram of a first oil guide groove of a pump body assembly in one embodiment of the present disclosure.

Figure 7:
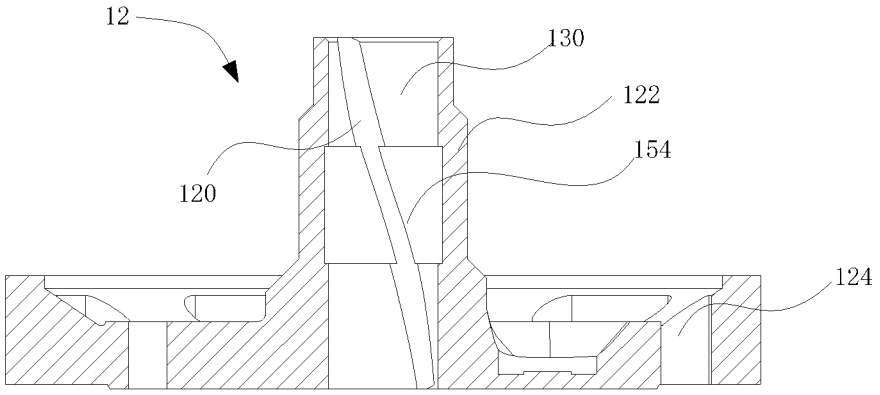

FIG. 7 shows a schematic diagram of a bearing structure in one embodiment of the present disclosure.

Figure 8:
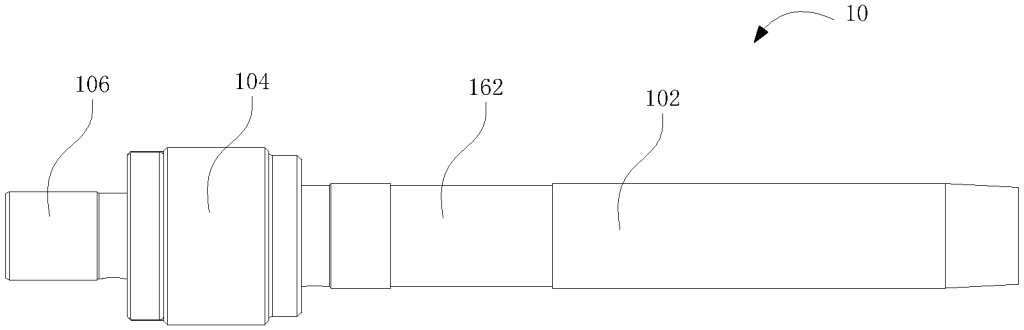

FIG. 8 shows a schematic diagram of a crankshaft structure in one embodiment of the present disclosure.

Figure 9:
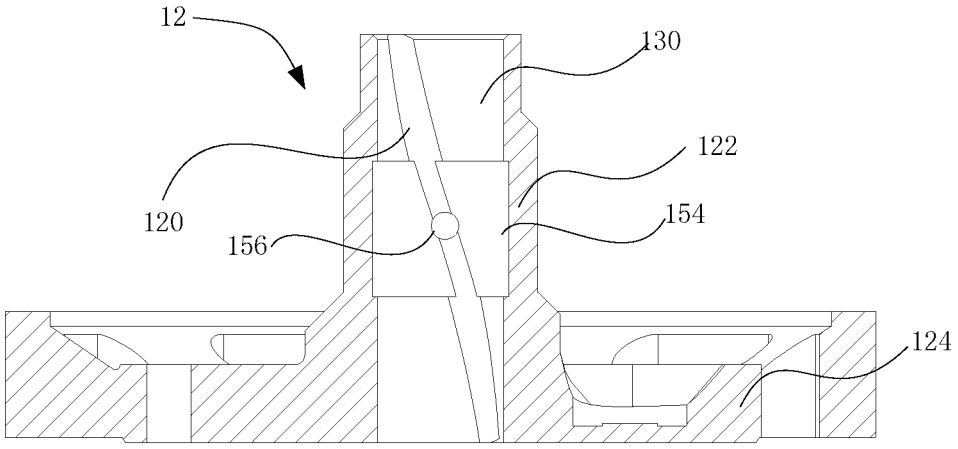

FIG. 9 shows a schematic diagram of a bearing structure in another embodiment of the present disclosure.

Figure 10:
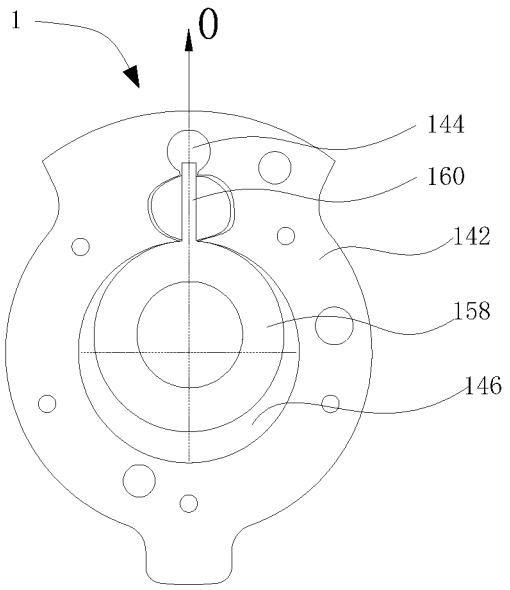

FIG. 10 shows a structural schematic diagram of a swing type compressor cylinder body in one embodiment of the present disclosure.

Figure 11:
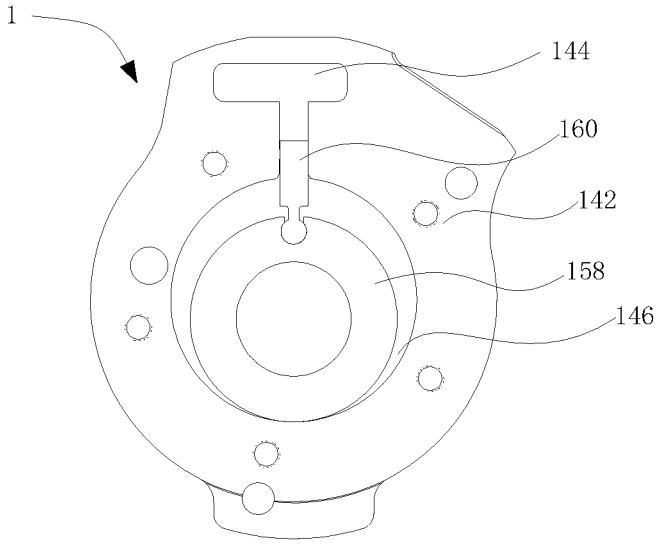

FIG. 11 shows a schematic diagram of a piston sliding vane hinged structure in one embodiment of the present disclosure.

Figure 12:
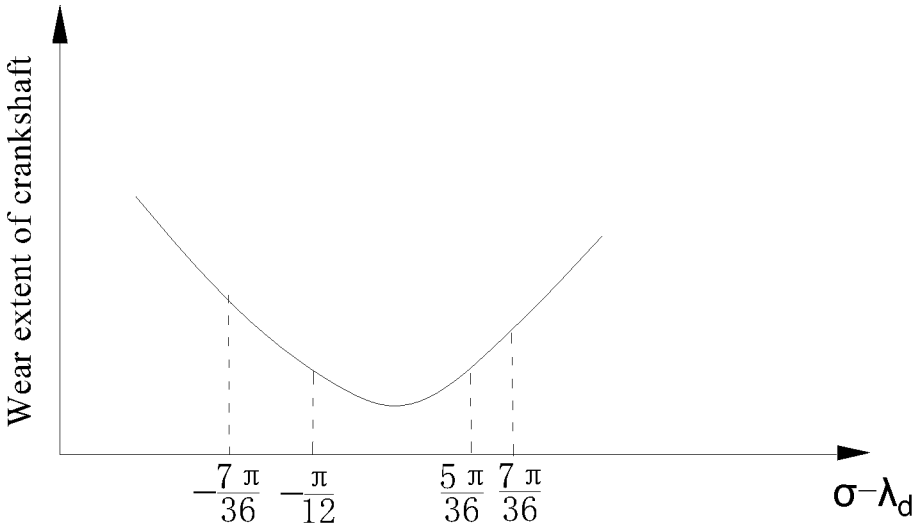

FIG. 12 shows a relational diagram of an included angle of a single-cylinder compressor and wear extent of a crankshaft in one embodiment of the present disclosure.

Figure 13:
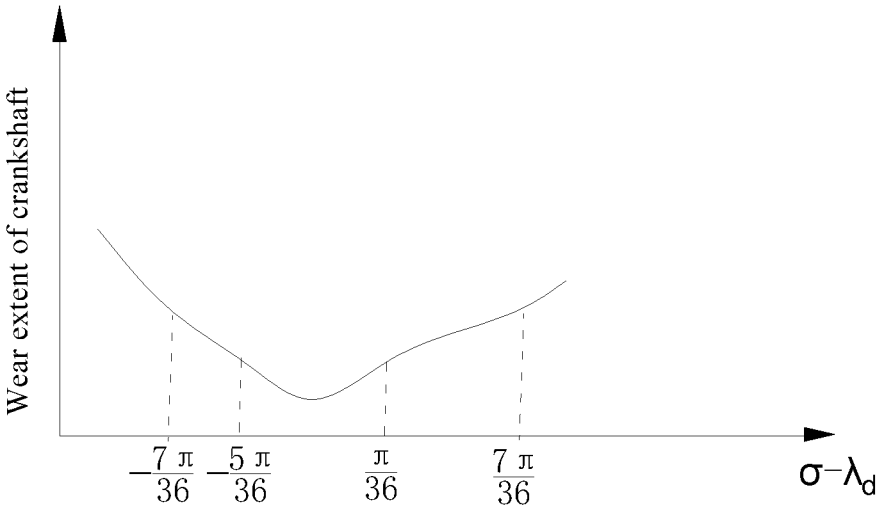

FIG. 13 shows a relational diagram of an included angle of a multi-cylinder compressor and wear extent of a crankshaft in one embodiment of the present disclosure.

The reference numerals and components designated by these numerals, as shown in FIG. 2 to FIG. 11, are described as follows:

1 pump body assembly; 10 crankshaft; 102 main shaft part; 104 eccentric part; 106 auxiliary shaft part; 12 main bearing; 120 first oil guide groove; 122 hub part; 124 flange part; 126 first connection line; 128 second connection line; 130 through hole; 142 cylinder body; 144 sliding vane slot; 146 center hole; 150 crankshaft rotation direction; 152 third connection line; 154 first annular groove; 156 oil passing hole; 158 piston; 160 sliding vane; and 162 second annular groove.

DETAILED DESCRIPTION OF EMBODIMENTS

To understand above purposes, features and advantages of the present disclosure more clearly, the present disclosure is further detailed below in combination with drawings and exemplary embodiments. It should be explained that if there is no conflict, embodiments in the present disclosure and the features in the embodiments can be mutually combined.

In the following description, many specific details are set forth in order to fully understand the present disclosure. However, the present disclosure can also be implemented in other ways than described herein. Therefore, the protection scope of the present disclosure is not limited by the following exemplary embodiments disclosed.

A pump body assembly 1, a compressor, and an air conditioner according to some embodiments of the present disclosure will be described below with reference to FIG. 2 to FIG. 13.

According to an embodiment of the present disclosure, a pump body assembly 1 is provided, including: a crankshaft 10 including a main shaft part 102 and an eccentric part 104 connected with the main shaft part 102, wherein a distance between a center line of the main shaft part 102 and a center line of the eccentric part 104 is e; a main bearing 12 including a hub part 122, wherein the main shaft part 102 penetrates through a through hole 130 in the hub part 122, and a first oil guide groove 120 is formed in the wall defining the through hole 130; and a cylinder body 142, wherein a sliding vane slot 144 and a center hole 146 are formed in the cylinder body 142, the crankshaft 10 penetrates through the center hole 146, the main bearing 12 is located at one side of the cylinder body 142, a radius of the center hole 146 is R, and a difference value between R and e is r. A value range of an included angle formed of a first connection line 126 between the center of the center hole 146 and that of the sliding vane slot 144 in the same projection plane and a second connection line 128 between a termination point of the first oil guide groove 120 at one end of the hub part 122 away from the eccentric part 104 and the center of the through hole 130 is smaller than or equal to sum of $17\pi/18$ and $$\frac{1}{2}\arcsin\left(\frac{e}{2r}\right),$$

and greater than or equal to sum of $$5\pi/9 \text{ and } \frac{1}{2}\arcsin\left(\frac{e}{2r}\right).$$

As shown in FIG. 4, the pump body assembly 1 provided by the present disclosure includes a crankshaft 10, a main bearing 12 and a cylinder body 142, wherein the crankshaft 10 includes a main shaft part 102 and an eccentric part 104 connected with the main shaft part 102, and a distance between a center line of the main shaft part 102 and a center line of the eccentric part 104 is e; the main bearing 12 includes a hub part 122 with a through hole 130 therein and a flange part 124, wherein a first oil guide groove 120 is formed in the wall defining the through hole 130, the main shaft part 102 penetrates through the through hole 130, and a center hole 146 and a sliding vane slot 144 in communication with the center hole 146 are formed in the cylinder body 142, the crankshaft 10 penetrates through the center hole 146 of the cylinder body 142, the main bearing 12 is arranged at the one side of the cylinder body 142, a radius of the center hole 146 is R, and a difference value between R and e is r. In the same projection plane in the axial direction of the center hole 146, a first connection line 126 between the center of the center hole 146 in the cylinder body 142 and the center of the sliding vane slot 144 is defined as a 0-degree direction, and the center of the center hole 146 is connected with the center of the sliding vane slot 144 to form the first connection line 126; a termination point of the first oil guide groove 120 at one end away from the eccentric part 104 is connected with the center of the through hole 130 in the hub part 122 to form a second connection line 128; an angle increase direction is the same with a crankshaft rotation direction 150; and a rotation angle corresponding to the rotation of the crankshaft 10 from the first connection line 126 to the second connection line 128 is an included angle, which is greater than or equal to $$5\pi/9+\frac{1}{2}\arcsin\left(\frac{e}{2r}\right)$$

and smaller than or equal to $$17\pi/18+\frac{1}{2}\arcsin\left(\frac{e}{2r}\right).$$

By defining a relationship among the included angle formed of the first connection line 126 between the center of the center hole 146 in the same projection plane in the axial direction of the center hole and the center of the sliding vane slot 144 and the second connection line 128 between the termination point of the first oil guide groove 120 at one end of the hub part 122 away from the eccentric part 104 and the center of the through hole 130, crankshaft 10 eccentricity e and the radius R of the center hole 146 of the cylinder body 142, oil supply of the oil grooves is more sufficient and an oil film on each portion of the main shaft part 102 of the crankshaft 10 is more uniform when the crankshaft 10 deforms under action of external load to be in contact with the main bearing 12, thereby effectively improving the problem of the abnormal wear of the main shaft part 102 of the crankshaft 10, avoiding the problems such as pump body blockage, crankshaft fracture and the like, and prolonging the service life of the compressor.

The lubrication principle and wear mechanism of the compressor crankshaft of the existing structure are briefly analyzed and explained below in conjunction with FIG. 1:

As shown in FIG. 1, the compressor pump body assembly includes a crankshaft 10', bearings and a cylinder body 142'. The crankshaft 10' includes a main shaft part 102', an eccentric part 104' and an auxiliary shaft part 106'. The bearings include a main bearing and an auxiliary bearing, the main bearing includes a main bearing profile 122' and a main bearing flange 124', and the main shaft part 102' is arranged at the main bearing profile 122'; the auxiliary bearing includes an auxiliary bearing hub 132' and an auxiliary bearing flange 134', the auxiliary shaft part 106' is arranged at the auxiliary bearing hub 132', and a spiral oil applying blade 112' mounted in an inner hole of the auxiliary shaft part 106' of the crankshaft 10' generally supplies oil to lubricate the crankshaft 10'. When the crankshaft 10' rotates, the oil applying blade 112' upwards supplies lubricating oil on the bottom of a compressor oil tank, transmits the lubricating oil into an inner hole of the main bearing and an inner hole of the auxiliary bearing through the main shaft part 102' of the crankshaft 10' and the oil hole 110' of the auxiliary shaft part 106'; and then, under action of the spiral oil guide grooves in the inner wall surfaces of the main and auxiliary bearings, the lubricating oil is supplied to the main shaft part 102' and the auxiliary shaft part 106' of the crankshaft so as to achieve lubricating effect on the main shaft part 102' and the auxiliary shaft part 106' of the crankshaft 10'. When the compressor is running, the crankshaft 10' deforms to tilt under action force of gas pressure, radial magnetic tension and centrifugal force of a balance block, and then is in contact with the bearings to generate contact stress. If the contact stress is too great or positions of bearing oil guide grooves are unreasonable, the crankshaft will generate abnormal wear with the bearings due to insufficient oil supply.

The relationship among the termination point of the oil guide groove of the main bearing and the crankshaft eccentricity, the radius of the cylinder body 142 and the like is deeply analyzed and researched in combination with a stress condition of the crankshaft based on the lubricating principle and wear mechanism of the crankshaft so as to disclose a novel design structure adopting a main bearing 12 as a spiral oil guide groove, which is simple to implement and remarkable in effect. It should be noted that the structure of the present disclosure is applicable to compressors using different refrigerants and lubricating oils.

In one embodiment of the present disclosure, the pump body assembly 1 is provided with one cylinder body 142, and the value range of the included angle is smaller than or equal to the sum of $8\pi/9$ and $$\frac{1}{2}\arcsin\left(\frac{e}{2r}\right),$$

and greater than or equal to the sum of $2\pi/3$ and $$\frac{1}{2}\arcsin\left(\frac{e}{2r}\right).$$

In the embodiment, when the pump body assembly 1 is a single-cylinder pump body assembly, the value range of the included angle meets the following formula: the included angle being greater than or equal to $$2\pi/3+\frac{1}{2}\arcsin\left(\frac{e}{2r}\right)$$

and smaller than or equal to $$8\pi/9+\frac{1}{2}\arcsin\left(\frac{e}{2r}\right)$$

In such a manner, oil supply of the oil grooves is more sufficient when the crankshaft 10 deforms under action of external load to be in contact with the main bearing 12.

In one embodiment of the present disclosure, the pump body assembly 1 is provided with at least two cylinder bodies 142, and the value range of the included angle is smaller than or equal to the sum of $7\pi/9$ and $$\frac{1}{2}\arcsin\left(\frac{e}{2r}\right),$$

and greater than or equal to the sum of $11\pi/18$ and $$\frac{1}{2}\arcsin\left(\frac{e}{2r}\right).$$

In the embodiment, when the pump body assembly 1 is a multi-cylinder pump body assembly, the value range of the included angle meets the following formula: the included angle being greater than or equal to $$11\pi/18+\frac{1}{2}\arcsin\left(\frac{e}{2r}\right)$$

and smaller than or equal to $$7\pi/9+\frac{1}{2}\arcsin\left(\frac{e}{2r}\right).$$

In such a manner, oil supply of the oil grooves is more sufficient when the crankshaft 10 deforms under action of external load to be in contact with the main bearing 12. Furthermore, in a process that a multi-cylinder compressor rotates around the crankshaft, gas force has a plurality of peak values, and there is greater difference between a direction (corresponding to a direction of centrifugal force) of a balance block and a single-cylinder compressor, so that the optimal range of the termination angle of the oil groove of the multi-cylinder compressor is not completely consistent with that of the single-cylinder compressor; and the positions of the oil grooves are different according to different numbers of the cylinder bodies, so that the best lubrication effect is achieved.

In one embodiment of the present disclosure, as shown in FIG. 5, the value range of the included angle formed of the first connection line 126 in the same projection plane of the pump body assembly 1 and a third connection line 152 between a termination point of the first oil guide groove 120 at another end and the center of the through hole 130 is smaller than or equal to $2\pi$ and greater than or equal to $3\pi/2$.

In the embodiment, the third connection line 152 is formed by the termination point at another end of the first oil guide groove 120 and the center of the through hole 130, and the included angle formed of the first connection line 126 and the third connection line 152 greatly affects the reliability of the crankshaft 10. By setting the value range of the included angle formed of the first connection line 126 and the third connection line 152 to be smaller than or equal to $2\pi$ and greater than or equal to $3\pi/2$, oil supply of the oil grooves is more sufficient and the reliability of the main shaft part 102 of the crankshaft 10 is better when the crankshaft 10 deforms under action of external load to be in contact with the main bearing 12.

In one embodiment of the present disclosure, as shown in FIG. 7, the pump body assembly 1 further includes a first annular groove 154 which is formed in the wall defining the through hole 130, and the first oil guide groove 120 is communicated with the first annular groove 154.

In the embodiment, the pump body assembly 1 further includes a first annular groove 154 formed in the wall defining the through hole 130, and the first annular groove 154 is communicated with the first oil guide groove 120; an annular groove is formed in the inner surface of the hub part 122 of the main bearing, oil supply amount between the hub part 122 of the main bearing and the main shaft part 102 of the crankshaft 10 may be further increased, so that a lubricating condition of the main shaft part 102 of the crankshaft 10 is improved. And meanwhile, contact area between the hub part 122 of the main bearing 12 and the main shaft part 102 of the crankshaft 10 is reduced through the first annular groove 154, so that viscous resistance and friction loss between the two are reduced, and the performance of the compressor is improved.

In one embodiment of the present disclosure, as shown in FIG. 9, the pump body assembly 1 further includes an oil passing hole 156 which is formed in the first annular groove 154, and the oil passing hole 156 penetrates through the hub part 122 in a radial direction.

In the embodiment, the oil passing hole 156 is formed in the first annular groove 154, and penetrates through the hub part 122 in the radial direction, so that circulating performance between lubricating oil on the inner surface of a hub and lubricating oil outside may be improved, and a temperature of the lubricating oil in the hub is reduced to certain extent. In such a manner, the lubricating reliability of the main shaft part 102 of the crankshaft 10 is further improved.

In one embodiment of the present disclosure, a radial depth of the first annular groove 154 of the pump body assembly 1 is smaller than or equal to 0.5 mm.

In the embodiment, the radial depth of the first annular groove 154 is limited to be not greater than 0.5 mm, such that the first annular groove 154 slightly affects the rigidity of the entire pump body assembly 1.

In one embodiment of the present disclosure, as shown in FIG. 8, the pump body assembly 1 further includes a second annular groove 162 which is formed in the main shaft part 102 and is located in an area wherein the main shaft part 102 is matched with the hub part 122.

In the embodiment, a second annular groove 162 is formed in the area wherein the main shaft part 102 is matched with the hub part 122, such that oil supply amount between the hub part 122 of the main bearing 12 and the main shaft part 102 of the crankshaft 10 may be further increased. In such a manner, a lubricating condition of the main shaft part 102 of the crankshaft 10 is improved. And meanwhile, contact area between the hub part 122 of the main bearing 12 and the main shaft part 102 of the crankshaft 10 is reduced through the second annular groove 162, so that viscous resistance and friction loss between the two are reduced, and the performance of the compressor is improved.

In one embodiment of the present disclosure, a radial depth of the second annular groove 162 of the pump body assembly 1 is smaller than or equal to 0.5 mm.

In the embodiment, the radial depth of the second annular groove 162 is limited to be not greater than 0.5 mm, such that the integral rigidity of the crankshaft is guaranteed. In such a manner, the second annular groove 162 slightly affects the rigidity of the entire pump body assembly 1.

In one embodiment of the present disclosure, the crankshaft 10 of the pump body assembly 1 further includes an auxiliary shaft part 106, and the eccentric part 104 is located between the main shaft part 102 and the auxiliary shaft part 106; the pump body assembly 1 further includes an auxiliary bearing; the main bearing is sleeved on the main shaft part 102; the auxiliary bearing is sleeved on the auxiliary shaft part 106; and the pump body assembly 1 further comprises a second oil guide groove (not shown in the figure) which is formed in a through hole 130 of the auxiliary bearing.

In the embodiment, as shown in FIG. 8, the crankshaft 10 further includes an auxiliary shaft part 106 which is connected with the eccentric part 104; the bearings include a main bearing 12 and an auxiliary bearing, which are respectively located at the two sides of the cylinder body 142; the main bearing 12 is matched with the main shaft part 102, the auxiliary bearing is matched with the auxiliary shaft part 106, the first oil guide groove 120 is formed in the through hole of the main bearing and the second oil guide groove is formed in the through hole of the auxiliary bearing. The first oil guide groove 120 is formed in the through hole of the main bearing, and the second oil guide groove is formed in the through hole of the auxiliary bearing, such that lubricating oil enters a position between the main bearing and the main shaft part 102 and a position between the auxiliary bearing and the auxiliary shaft part 106. In such a manner, a lubricating condition between the main shaft part 102 and the auxiliary shaft part 106 of the crankshaft 10 is improved.

In one embodiment of the present disclosure, the pump body assembly 1 further includes: the value range of the included angle formed of the first connection line 126 between the center of the center hole 146 in the same projection plane and the center of the sliding vane slot 144 and a fourth connection line between a termination point of the second oil guide groove at one end of the hub part 122 close to the eccentric part 104 and the center of the through hole 130 is smaller than or equal to $2\pi$ and greater than or equal to $3\pi/2$.

In the embodiment, in the same projection plane in the axial direction of the center hole 146, the termination point of the second oil guide groove at one end of the hub part 122 close to the eccentric part 104 and the center of the through hole 130 define the fourth connection line; when the value range of the included angle formed of the first connection line 126 and the fourth connection line is smaller than or equal to $2\pi$ and greater than or equal to $3\pi/2$, oil supply of the oil groove is more sufficient and integral reliability of the crankshaft is better when the crankshaft 10 deforms under action of external load to be in contact with the auxiliary bearing.

In one embodiment of the present disclosure, the first oil guide groove 120 and the second oil guide groove of the pump body assembly 1 are both spiral oil guide grooves.

In the embodiment, the first oil guide groove 120 and the second oil guide groove are both spiral oil guide grooves; in a running process of the compressor, flowing of lubricating oil is facilitated, such that the inner wall surface of the main bearing 12 and the inner wall surface of the auxiliary bearing supply lubricating oil to the main shaft part 102 and the auxiliary shaft part 106 of the crankshaft 10 under action of the spiral oil guide grooves. In such a manner, the main shaft part 102 and the auxiliary shaft part 106 of the crankshaft 10 are both lubricated.

In one embodiment of the present disclosure, spiral directions of the first oil guide groove 120 and the second oil guide groove of the pump body assembly 1 are the same with the rotation direction of the crankshaft 10.

In the embodiment, the spiral direction of the first oil guide groove 120 and the spiral direction of the second oil guide groove are the same with the rotation direction of the crankshaft 10, such that lubricating oil may enter the first oil guide groove 120 and the second oil guide groove under action of centrifugal force, and oil supply amount between the hub of the main bearing 12 and the shaft part of the crankshaft 10 is increased; the spiral direction of the first oil guide groove 120 is the same with that of the second oil guide groove, such that the lubricating oil enters each position wherein the crankshaft 10 is in contact with the hub part 122.

In one embodiment of the present disclosure, the value range of the width of the first oil guide groove 120 of the pump body assembly 1 is smaller than or equal to 5 mm and greater than or equal to 1.5 mm; and the value range of the depth of the first oil guide groove 120 is smaller than or equal to 3 mm and greater than or equal to 0.3 mm.

In the embodiment, as shown in FIG. 6, when the value range of the width a of the first oil guide groove 120 is greater than or equal to 1.5 mm and smaller than or equal to 5 mm, the value range of the depth b of the first oil guide groove 120 is greater than or equal to 0.3 mm and smaller than or equal to 3 mm, lubricating reliability of the crankshaft 10 is better.

In an exemplary embodiment, a direction that a connection line of the center of the cylinder body 142 of the gas cylinder and the center of the sliding vane slot 144 points to the sliding vane slot 144 is defined as a 0-degree direction; as shown in FIG. 2, the angle increase direction is the same with the crankshaft rotation direction 150. Unless otherwise specified, all angles are based on this. In the embodiment, a piston 158 is sleeved outside the eccentric part 104 of the crankshaft 10, and the outer radius dimension of the piston 158 is r equal to R-e.

As shown in FIG. 3, M is a center point of the cylinder body 142 of the gas cylinder, N is a center point of the piston 158, A is a point of tangency of the piston 158 and the sliding vane 160 (for the sake of simplicity, swing of the point A of tangency is neglected in the following calculation with smaller errors), B is a point of tangency of the piston 158 and the cylinder body 142 of the gas cylinder, $\theta$ is a rotation angle of the crankshaft, $\alpha$ is a directional angle of resultant force of gas force, $\beta$ is an included angle between AM and AN, $\delta$ is an included angle between AN and AB, r is an outer radius of the piston 158, and e is crankshaft eccentricity, wherein the angle dimensions above meet the following geometric relations:

$$\sin\beta = \frac{e\ \sin(\theta-\pi)}{r} \tag{1}$$

$$\text{So: } \beta = \arcsin\left[\frac{e\ \sin(\theta-\pi)}{r}\right] \tag{2}$$

$$\text{and: } \theta-\pi = 2\delta+\beta \tag{3}$$

$$\text{So: } \delta = \frac{1}{2}(\theta-\beta-\pi) \tag{4}$$

$$\alpha = \frac{\pi}{2}+\beta+\delta \tag{5}$$

By combining formulas (2), (4) and (5), get:

$$\alpha = \frac{1}{2}\theta + \frac{1}{2}\arcsin\left[\frac{e\ \sin(\theta-\pi)}{r}\right] \tag{6}$$

According to related calculation for lubrication of the main bearing 12, an angle, in a practical direction of motion under action of gas force, of the crankshaft 10 may advance by about π/6 relative to the direction angle α of the gas force, and thus, the angle, in the practical direction of motion, of the crankshaft 10 is as follows:

$$\lambda = \frac{\pi}{6} + \frac{1}{2}\theta + \frac{1}{2}\arcsin\left[\frac{e\sin(\theta-\pi)}{r}\right] \tag{7}$$

For existing compressor types including refrigerants such as R22, R410A, R32, R290, R134a and the like, a gas exhaust angle (a rotation angle of the crankshaft 10 when gas exhaust is just started after refrigerants are compressed) is generally about 7π/6, which is substituted into θ in the formula (7) to obtain an angle, in the direction of motion of the crankshaft, corresponding to the gas exhaust angle as follows:

$$\lambda_d = \frac{3\pi}{4} + \frac{1}{2}\arcsin\left(\frac{e}{2r}\right) \tag{8}$$

The gas force on the crankshaft 10 is the maximum value during gas exhaust, and radial motion of the crankshaft 10 is maximal, such that influences on lubrication of the main shaft part 102 are also maximal. According to a large number of experimental studies, there is a great relation specifically as shown in following FIG. 12 among wear extent of the main shaft part 102 of the crankshaft 10, a termination angle σ of the oil groove of the main bearing away from the gas cylinder 142, and a practical motion angle d of the crankshaft 10 during gas exhaust. When a difference value of σ−d ranges from −7π/36 to 7π/36, the wear extent of the main shaft part 102 of the crankshaft 10 is smaller and the reliability of the crankshaft 10 is higher; $-7\pi/36 \le \sigma - d \le 7\pi/36$ is substituted into the formula (8) to obtain an optimal range of the termination angle α of the oil groove of the main bearing 12 away from the gas cylinder as follows:

$$\frac{5\pi}{9} + \frac{1}{2}\arcsin\left(\frac{e}{2r}\right) \le \sigma \le \frac{17\pi}{18} + \frac{1}{2}\arcsin\left(\frac{e}{2r}\right)$$

Furthermore, for the single-cylinder pump body assembly and the single-cylinder compressor, the optimal range of the difference value of a-d is greater than −π/12 and smaller than 5π/36, and the range of the termination angle σ of the oil groove is as follows:

$$\frac{2\pi}{3} + \frac{1}{2}\arcsin\left(\frac{e}{2r}\right) \le \sigma \le \frac{8\pi}{9} + \frac{1}{2}\arcsin\left(\frac{e}{2r}\right)$$

Furthermore, for the multi-cylinder pump body assembly and the multi-cylinder compressor, as shown in FIG. 13, the optimal range of the difference value of σ−d is greater than −5π/36 and smaller than π/36, and the range of the termination angle σ of the oil groove is as follows:

$$\frac{11\pi}{18} + \frac{1}{2}\arcsin\left(\frac{e}{2r}\right) \le \sigma \le \frac{7\pi}{9} + \frac{1}{2}\arcsin\left(\frac{e}{2r}\right)$$

In a process that the multi-cylinder compressor rotates around the crankshaft 10, gas force has a plurality of peak values, and there is greater difference between a direction (corresponding to a direction of centrifugal force) of a balance block and the single-cylinder compressor, so that the optimal range of the termination angle of the oil groove of the multi-cylinder compressor is not completely consistent with that of the single-cylinder compressor.

In an exemplary embodiment, the first oil guide groove 120 of the main bearing 12 is a spiral oil guide groove, and the rotation direction of the spiral oil guide groove is consistent with the rotation direction of the crankshaft 10.

In an exemplary embodiment, as shown in FIG. 5, the range of the angle GO of the termination point of the first oil guide groove 120 of the main bearing 12 close to the cylinder body 142 also greatly affects the reliability of the main shaft part 102 of the crankshaft 10. Based on the study, when GO is greater than or equal to 3π/2 and smaller than or equal to 2π, the reliability of the main shaft part 102 of the crankshaft 10 is better; similarly, when a starting angle φ of the second oil guide groove of the auxiliary bearing close to the cylinder body 142 is greater than or equal to 3π/2 and smaller than or equal to 2π, the reliability of the auxiliary shaft part 106 is better.

The width a and the depth b of the first oil guide groove 120 also greatly affect the lubricating reliability; and when the range of the width a of the first oil guide groove 120 is greater than or equal to 1.5 mm and smaller than or equal to 5 mm and the range of the depth b is greater than or equal to 0.3 mm and smaller than or equal to 3 mm, the integral reliability of the crankshaft 10 is better.

It should be noted that the angles of the oil grooves mentioned in the embodiment are all an included angle between the connection line of the termination point of the first oil guide groove 120 and the center of the main bearing 12, and the 0-degree angle.

In one embodiment of the present disclosure, as shown in FIG. 7, a first annular groove 154, a radial depth of which is not greater than 0.5 mm, is formed in the inner surface of the hub of the main bearing 12. The first annular groove 154 is formed in the inner surface of the hub of the main bearing 12, so that oil supply amount between the hub of the main bearing 12 and the shaft part of the crankshaft 10 may be further increased. In such a manner, a lubricating condition of the shaft part of the crankshaft 10 is improved. And meanwhile, contact area between the hub part 122 of the main bearing and the shaft part of the crankshaft 10 is reduced through the first annular groove 54, so that viscous resistance and friction loss between the two are reduced, and the performance of the compressor is improved. The radial depth dimension of the first annular groove 154 is limited to be not greater than 0.5 mm, such that the first annular groove 154 is ensured to slightly affect the rigidity of the entire pump body assembly 1.

In one embodiment of the present disclosure, as shown in FIG. 8, a second annular groove 162 is formed in the main shaft part 102 of the crankshaft 10, and the area which is in contact with the hub part 122 of the main bearing also guarantees the depth of the second annular groove 162 to be not greater than 0.5 mm; and the principle is similar with the principle of forming the annular groove in the inner surface of the hub part 122 of the main bearing 12, which is not further described here.

In one embodiment of the present disclosure, as shown in FIG. 9, a radial oil passing hole 156 is additionally formed in the hub of the main bearing 12, and the oil passing hole 156 penetrates through inner and outer surfaces of the hub part 122 and is located in the area of the first annular groove 154. The oil passing hole 156 which penetrates through in the radial direction is formed, so that circulating performance between lubricating oil on the inner surface of the hub part 122 and lubricating oil outside may be improved, and the temperature of the lubricating oil in the hub is reduced to certain extent. In such a manner, lubricating reliability of the shaft part of the crankshaft 10 is further improved.

In the above embodiments, application on a rolling piston type compressor of the present disclosure is described in detail, and the present disclosure is not limited to the rolling piston type compressor. For example, for a piston sliding vane integrated swing type structure (as shown in FIG. 10) or a piston 158 and sliding vane 160 hinged structure (as shown in FIG. 11), the present disclosure still may be applied with no great difference in implementation way, which takes a direction that the connection line of the center of the cylinder body 142 of the gas cylinder and the center of the sliding vane slot 144 points to the sliding vane slot 144 as a 0-degree direction; if the center of the sliding vane slot 144 cannot be readily determined, the rotation angle of the crankshaft 10 when a gas suction cavity and a gas exhaust cavity of the gas cylinder are combined into one cavity is defined as a 0-degree angle. The angle increase direction is the same with the crankshaft rotation direction 150, and the optimal range of the termination angle σ of the main bearing 12 away from the gas cylinder is still as follows:

$$\frac{5\pi}{9} + \frac{1}{2}\arcsin\left(\frac{e}{2r}\right) \le \sigma \le \frac{17\pi}{18} + \frac{1}{2}\arcsin\left(\frac{e}{2r}\right)$$

The specific implementation way in the solutions of the present disclosure is schematically illustrated, may be changed correspondingly based on this in specific implementation, and should not be taken as limiting the scope of the present disclosure. For example, the termination angle σ of the main bearing 12 at the hub away from the gas cylinder is limited as $$\frac{5\pi}{9} + \frac{1}{2}\arcsin\left(\frac{e}{2r}\right) \le \sigma \le \frac{17\pi}{18} + \frac{1}{2}\arcsin\left(\frac{e}{2r}\right),$$

but the number and shapes of the oil grooves are not limited, that is to say, the oil grooves with number and shapes meeting the angle requirements are deemed to be within the protective scope of the present disclosure.

According to an embodiment of a second aspect of the present disclosure, a compressor is provided, including the pump body assembly 1 according to any of the embodiments. As a result, the compressor has all the beneficial effects of the pump body assembly 1, which will not be detailed here.

According to an embodiment of a third aspect of the present disclosure, an air conditioner is provided, including the pump body assembly 1 or the compressor according to any of the embodiments. As a result, the air conditioner has all the beneficial effects of the pump body assembly 1 or the compressor, which will not be detailed here.

In the present disclosure, the term "a plurality of" means two or more, unless otherwise specifically regulated. Terms such as "installation", "connected", "connecting", "fixation" and the like shall be understood in broad sense, and for example, "connecting" may refer to fixed connection or detachable connection or integral connection, and "connected" may refer to direct connection or indirect connection through an intermediate medium. For those ordinary skilled in the art, the specific meanings of the above terms in the present disclosure may be understood according to concrete conditions.

In the illustration of this description, the illustration of terms of "one embodiment", "some embodiments", "specific embodiments", etc. means that specific features, structures, materials or characteristics illustrated in combination with the embodiment or example are included in at least one embodiment or example of the present disclosure. In this description, exemplary statements for the above terms shall not necessarily refer to the same embodiment or example. Moreover, the described specific features, structures, materials or characteristics can be combined appropriately in any one or more embodiments or examples.

The above only describes preferred embodiments of the present disclosure and is not intended to limit the present disclosure. For those skilled in the art, various variations and changes can be made to the present disclosure. Any modification, equivalent replacement, improvement, etc. made within the spirit and the principle of the present disclosure shall be included within the protection scope of the present disclosure.

What is claimed is:

1. A pump body assembly comprising:

a crankshaft comprising a main shaft part and an eccentric part connected with the main shaft part;

a main bearing comprising a hub part, wherein the main shaft part extends through a through hole in the hub part, and a first oil guide groove is formed in a wall defining the through hole; and a cylinder body, wherein a sliding vane slot and a center hole are formed in the cylinder body, the crankshaft extends through the center hole, and the main bearing is located at one side of the cylinder body, wherein:

a distance between a center line of the main shaft part and a center line of the eccentric part is e;

a radius of the center hole is R, and a difference value between R and e is r;

a value range of an included angle formed of a first connection line between a center of the center hole and a center of the sliding vane slot in a same projection plane and a second connection line between a termination point of the first oil guide groove at one end of the hub part away from the eccentric part and a center of the through hole is smaller than or equal to the sum of 17π/18 and $$\frac{1}{2}\arcsin\left(\frac{e}{2r}\right),$$

and greater than or equal to the sum of 5π/9 and $$\frac{1}{2}\arcsin\left(\frac{e}{2r}\right);$$

and the included angle of the pump body assembly is a rotation angle corresponding to the rotation of the crankshaft from the first connection line to the second connection line.

2. The pump body assembly according to claim 1, wherein:

the pump body assembly is provided with one cylinder body, and the value range of the included angle is smaller than or equal to the sum of 8π/9 and $$\frac{1}{2}\arcsin\left(\frac{e}{2r}\right),$$

and greater than or equal to the sum of 2π/3 and $$\frac{1}{2}\arcsin\left(\frac{e}{2r}\right).$$

3. The pump body assembly according to claim 1, wherein:

the pump body assembly is provided with at least two cylinder bodies, and the value range of the included angle is smaller than or equal to the sum of 7π/9 and $$\frac{1}{2}\arcsin\left(\frac{e}{2r}\right),$$

and greater than or equal to the sum of 11π/18 and $$\frac{1}{2}\arcsin\left(\frac{e}{2r}\right).$$

4. The pump body assembly according to claim 1, wherein:

the value range of the included angle formed of the first connection line in the same projection plane of the pump body assembly and a third connection line between a termination point at the other end of the first oil guide groove and the center of the through hole is smaller than or equal to 2π and greater than or equal to 3π/2.

5. The pump body assembly according to claim 1, wherein:

the pump body assembly further comprises a first annular groove which is formed in the wall defining the through hole, and the first oil guide groove is communicated with the first annular groove.

6. The pump body assembly according to claim 5, wherein the pump body assembly further comprises an oil passing hole formed in the first annular groove, the oil passing hole extending through the hub part in a radial direction.

7. The pump body assembly according to claim 5, wherein a radial depth of the first annular groove is smaller than or equal to 0.5 mm.

8. The pump body assembly according claim 7, wherein the pump body assembly further comprises a second annular groove formed in the main shaft part and located in an area where the main shaft part is matched with the hub part.

9. The pump body assembly according to claim 8, wherein a radial depth of the second annular groove is smaller than or equal to 0.5 mm.

10. The pump body assembly according to claim 1, wherein:

the crankshaft further comprises an auxiliary shaft part, and the eccentric part is located between the main shaft part and the auxiliary shaft part, the pump body assembly further comprises an auxiliary bearing, the main bearing is sleeved on the main shaft part, and the auxiliary bearing is sleeved on the auxiliary shaft part, and the pump body assembly further comprises a second oil guide groove which is formed in a through hole of the auxiliary bearing.

11. The pump body assembly according to claim 10, wherein the value range of the included angle formed of the first connection line between the center of the center hole in the same projection plane and the center of the sliding vane slot and a fourth connection line between a termination point of the second oil guide groove at one end of the hub part close to the eccentric part and the center of the through hole is smaller than or equal to 2π and greater than or equal to 3π/2.

12. The pump body assembly according to claim 10, wherein the first oil guide groove and the second oil guide groove are both spiral oil guide grooves.

13. The pump body assembly according to claim 12, wherein spiral directions of the first oil guide groove and the second oil guide groove are the same with a rotation direction of the crankshaft.

14. The pump body assembly according to claim 1, wherein:

a value range of a width of the first oil guide groove is smaller than or equal to 5 mm and greater than or equal to 1.5 mm; and a value range of a depth of the first oil guide groove is smaller than or equal to 3 mm and greater than or equal to 0.3 mm.

15. A compressor comprising the pump body assembly according to claim 1.

16. An air conditioner comprising the compressor according to claim 15.

* * * * *